US007770987B2

(12) United States Patent
Nakasendo

(10) Patent No.: US 7,770,987 B2
(45) Date of Patent: Aug. 10, 2010

(54) IMAGE FORMING APPARATUS

(75) Inventor: Takashi Nakasendo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 489 days.

(21) Appl. No.: 11/372,135

(22) Filed: Mar. 10, 2006

(65) Prior Publication Data

US 2006/0201889 A1 Sep. 14, 2006

(30) Foreign Application Priority Data

Mar. 11, 2005 (JP) ..... 2005-068412

(51) Int. Cl.
*B41J 29/38* (2006.01)
*B41J 2/385* (2006.01)
*G03G 15/00* (2006.01)
*G03G 15/08* (2006.01)

(52) U.S. Cl. ..... 347/5; 347/131; 399/24; 399/27

(58) Field of Classification Search ..... 347/122, 347/237, 247

See application file for complete search history.

(56) References Cited

U.S. PATENT DOCUMENTS 7,330,673 B2 * 2/2008 Eom ..... 399/24
2003/0048350 A1 * 3/2003 Sato ..... 347/237
2005/0280694 A1 * 12/2005 Tsujino et al. ..... 347/238

FOREIGN PATENT DOCUMENTS

JP 2004-233436 8/2004

* cited by examiner

*Primary Examiner*—Stephen D Meier
*Assistant Examiner*—Kar Yip
(74) *Attorney, Agent, or Firm*—Rabin & Berdo, P.C.

(57) ABSTRACT

An image forming apparatus capable of detecting a precise toner consumption amount has a system counting up a turned-on dot number of image data, outputting weight factors corresponding to the respective sub-line's numbers based on the respective sub-line numbers of the plural sub-lines at which a light emitting amount of each dot is varied periodically, and calculating the light emitting amount based on a dot counter value of the turned-on dot number and the weight factor corresponding to the respective sub-line's numbers, to summate the calculated light emitting amounts to estimate the toner consumption amount with high accuracy.

6 Claims, 6 Drawing Sheets

| LINE NUMBER | SUB-LINE NUMBER | BIT 0 | BIT 1 | BIT 2 | BIT 3 |
|---|---|---|---|---|---|
| 1 | 1 | 1 | 1 | 1 | 0 |
| | 2 | 1 | 1 | 1 | 1 |
| | 3 | 1 | 1 | 0 | 1 |
| | 4 | 1 | 1 | 1 | 0 |
| | 5 | 1 | 0 | 1 | 0 |
| | 6 | 1 | 1 | 0 | 1 |
| | 7 | 1 | 1 | 1 | 1 |
| | 8 | 1 | 0 | 1 | 1 |
| 2 | 1 | 1 | 1 | 1 | 1 |
| | 2 | 1 | 0 | 1 | 1 |
| | 3 | 1 | 1 | 1 | 0 |
| | 4 | 1 | 0 | 0 | 1 |

IMAGE FORMING APPARATUS

BACKGROUND OF THE INVENTION

1. Field of the Invention

This invention relates to an image forming apparatus using an electrophographic method and, more particularly, to an image forming apparatus precisely detecting a consumption amount of toners.

2. Description of Related Art

In electrophotographic recording apparatuses such as electrophotographic printers, after a surface of a photosensitive drum is negatively charged uniformly with a charging roller, electrostatic latent images are written over the surface with an LED (light emitting device) head. Toner images are formed to the electrostatic latent images using such as developing rollers and toner conveying rollers. The toner image is transferred to a recording medium with a transfer device. The transferred toner is fixed to the recording medium using a fixing device. A part of toner remaining on the surface of the photosensitive drum after the fixing step is carried to the developing roller as remaining on the surface of the photosensitive drum and is collected by the developing roller. The collected toner is reused as mixed with the toner stored in the developing device. Images are reproduced as the above processes are successively repeated. As an example of such an electrophotographic printer, an apparatus has been known in which a voltage supplied to the developing roller is adjusted according to a degree of impairment in device's specification (see, e.g., Japanese Patent Application Publication (JA) No. 2004-233,436).

With such a conventional electrophotographic system, as described above, the toner consumption amount is detected by counting up printing dots of image data to be printed. For example, where the sizes of the printing dots are changed at each printing dot by making the exposure amounts (or light emitting amounts) from the LED head different from one another, however, some deviations may occur between the toner consumption amount calculated by counting up the printing dots and the actual toner consumption amount, so that there raises a problem such that a precise toner consumption amount cannot be obtained.

It is an object of the invention to provide an image forming apparatus capable of calculating a toner consumption amount.

BRIEF SUMMARY OF THE INVENTION

In accordance with one feature of the present invention, an image forming apparatus includes a dot counter for counting up a turned-on dot number of image data; a sub-line counter for outputting each sub-line number of plural sub-lines whose light emitting amount is periodically changed at respective dots; a sub-line weight factor memory for holding and outputting, on the basis of the output of said sub-line counter, each weight factor corresponding to respective sub-line numbers; a light emitting amount calculating section for calculating a light emitting amount based on a dot count value outputted from said dot counter and the weight factor outputted from said sub-line weight factor memory; and a summation section for summating the light emitting amount calculated at said light emitting amount calculating section.

Where the dot counter value assigned to each sub-line is multiplied by the weight factor to render setting of the weight factor correspond to the light emitting amount of the dot at each sub-line periodically changing, the toner amount consumed according to the respective dots can be calculated precisely at each time, and as a whole the toner consumption amount consumed in this image forming apparatus can be calculated accurately.

BRIEF DESCRIPTION OF THE DRAWINGS

The above and other objects, features and advantages of the present invention will become more apparent from the following description of the presently preferred exemplary embodiments of the invention taken in conjunction with the accompanying drawings, in which.

DETAILED DESCRIPTION OF THE EMBODIMENTS

Figure 1:
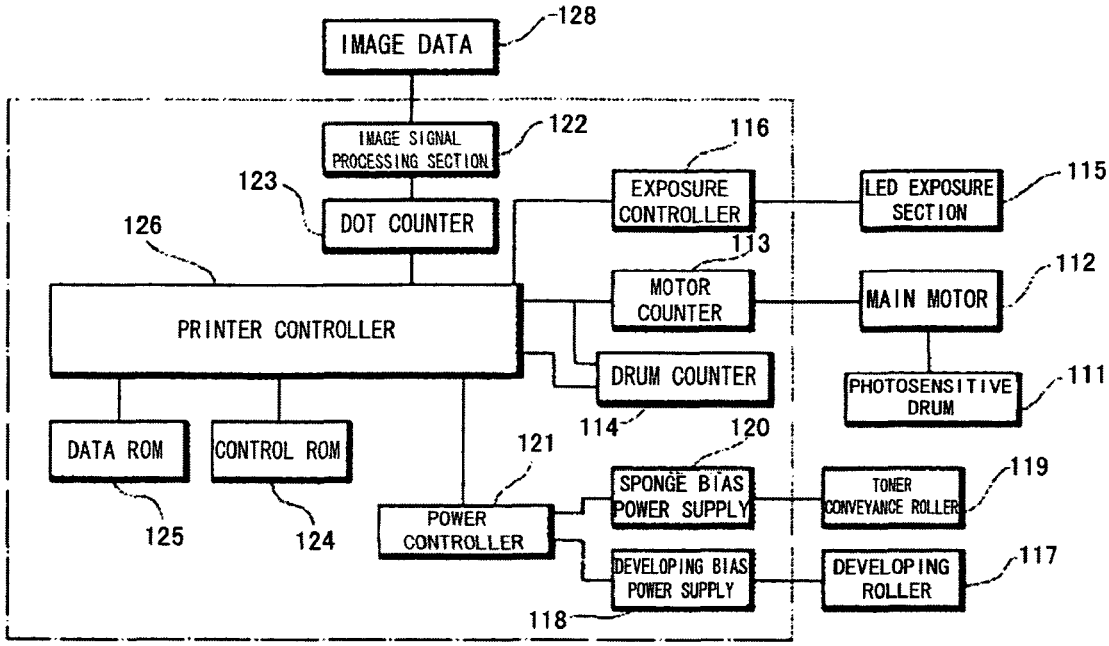
FIG. 1 is a block diagram showing main components of an electrophotographic printer to which an embodiment of the invention applies.

Referring to the drawings, an electrophotographic printer, as an example of an image forming apparatus, according to the invention is described. In FIG. 1, the electrophotographic printer includes a photosensitive drum 111, a main motor 112, a motor driver 113, a drum counter 114, an LED exposure section 115, an exposure controller 116, a developing roller 117, a developing bias power supply 118, a toner conveyance roller 119, a sponge bias power supply 120, a power controller 121, an image signal processing section 122, a dot counter 123, a control ROM (Read Only Memory) 124, a data ROM 125, and a printer controller 126.

Figure 2:
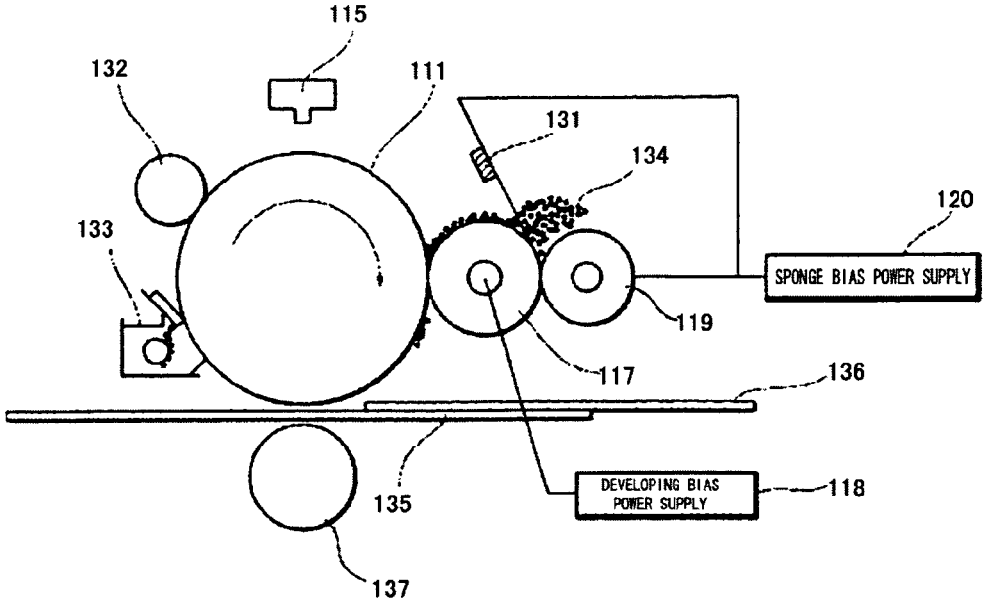
FIG. 2 is an illustration showing a structure around a photosensitive drum of the electrophotographic printer to which the embodiment of the invention applies.

The photosensitive drum 111 is a center portion of electrophotographic printer operation and rotates in a direction along an arrow in FIG. 2. The photosensitive drum 111 serves as an electrostatic latent image carrier. The surface of the photosensitive drum 111 is generally covered with an insulator having a high heat resistance such as a rubber material. The photosensitive drum 111 is rotated according to the main motor 112 driven by the motor driver 113 on the basis of control of the printer controller 126. The rotation number of the photosensitive drum 111 is measured by the drum counter 114, and the data is stored in the data ROM 125.

A charging roller 132 is a portion to charge a surface of the photosensitive drum 111 at, e.g., around −800V. The charging roller 132 is biased to a negative high voltage, not shown. The LED exposure section 115 is a portion for forming electrostatic latent images of image data 128 by radiating light ray to the surface of the photosensitive drum 111 charged at about −800V. Light emitting devices such as an LED array are used as such an LED exposure section. This section 115 is controlled by the exposure controller 116.

The image signal processing section 122 converts the image data 128 into dot data. Light rays corresponding to the dot data are radiated to the surface of the photosensitive drum 111 out of the LED exposure section 115. The surface potential of the radiated portion is increased to nearly zero V. In such a manner, a potentially changed portion, or namely, an electrostatic latent image is formed on the photosensitive drum 111.

The dot counter 123 is a section for counting up a dot number of the image data of an original document for one sheet of A4 size paper, which is comparable to a letter size paper, at a time that the image signal processing section 122 converts the image data into the dot data. The counted dot number is memorized in the data ROM 125. The developing roller 117 is a member for making development by clinging the toner 134 to the electrostatic latent image portion on the photosensitive drum 111. The surface potential of the developing roller 117, which serves as a developing agent carrier, is kept at around, e.g., −300V by means of the developing bias power supply 118.

The toner conveyance roller 119 is a member supplying toner to the developing roller 117. The surface potential of the toner conveyance roller 119 is kept at around, e.g., −400V by the sponge bias power supply 120. The power supply controller 121 is a section for setting and modifying the surface potentials of the developing roller 117 and the toner conveyance roller 119 according to control from the printer controller 126.

The developing blade 131 is a member for limiting the toner amount of the toner layer formed on the developing roller 117. The transfer roller 137 is a member for transferring the toner images formed on the photosensitive drum 111 onto a paper 136. Positive high voltage is supplied to the transfer roller 137 to transfer the toner negatively charged on the photosensitive drum 111 onto the paper 136.

A transfer belt 135 is a member driven by conveyance rollers, not shown, for conveying the paper 136. A cleaning device 133 is a device for removing remaining toner on the photosensitive drum 111. It is to be noted that the remaining toner not removed at the cleaning device is carried to the developing roller 117 as being attached to the surface of the photosensitive drum 111 and is corrected with the developing roller 117 to be reused. The control ROM 124 is a section for storing programs and tables necessary for control of this electrophotographic printer. The printer controller 126 is a CPU (central processing unit) for controlling the entire electrophotographic printer.

It is to be noted that the image signal processing section 122, the dot counter 123, and the power supply controller 121 can be formed individually as independent components but also can be contained in the control program as functions of the printer controller 126. In a case that the control program contains those, the programs are stored in advance in the control ROM 124.

Figure 3:
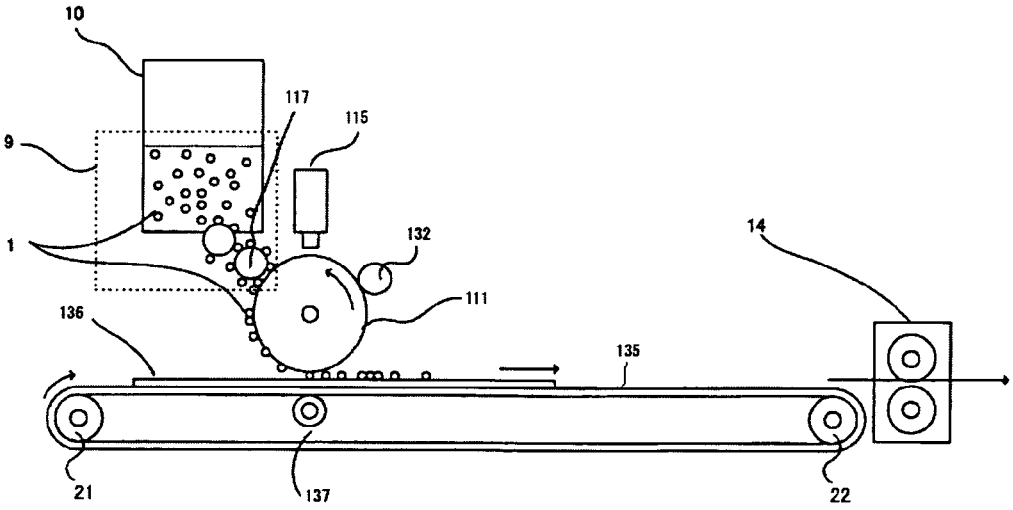
FIG. 3 is an illustration showing a further detailed structure around an image carrier according to the embodiment of the invention.

Now, referring to FIG. 3, the embodiment of the invention is described in detail. In this electrophotographic printer, as shown in FIG. 3, the surface of the photosensitive drum 111 serving as an image carrier is charged, and an electrostatic latent image is formed on the surface of the photosensitive drum 111 upon exposing the photosensitive drum 111 with the LED exposure section 115 in accordance with the printing data transmitted out of an image controller 15, a part of the printer controller 126. Toner 11 serving as a developing agent filled in a toner cartridge 10 is supplied through the developing roller 117, and a toner image is developed on the photosensitive drum 111 on which electrostatic latent image is formed by the LED exposure section 115. The developed toner image in use of the transfer roller 137 is transferred to the paper 136 as a printing medium, and then, an image is formed on the paper 136 by fixture with a fixing device 14.

The paper 136 is formed as to be conveyed on a belt moving in a circulating manner between drive rollers 21, 22, and the toner image on the surface of the photosensitive drum 111 is transferred when the paper 136 passes below the photosensitive drum 111. The LED exposure section 115 is structured of, e.g., an LED head in which plural light emitting diodes are disposed as facing to a rod lens array. Each light emitting diode is driven by driver ICs disposed adjacently thereto, and the drive IC turns on the light emitting diode according to printing data provided from the image controller as described below.

In this embodiment, light emitting operation at the LED exposure section 115 is done by setting prescribed light emitting amounts for respective divided time frames where a time for emitting light for pixels is divided, by selectively turning on and off the light emitting sections for the respective time frames based the printing data to control the accumulated light emitting amount for each pixel. This embodiment uses a system in which one main scanning line is divided into eight scanning sub-lines. It is to be noted that division into eight sub-lines is merely an example, that the one main scanning line can be divided by any of other numbers, and that partly a time frame can be divided not evenly as to make one divided time frame different from another divided time frame.

Figure 5:
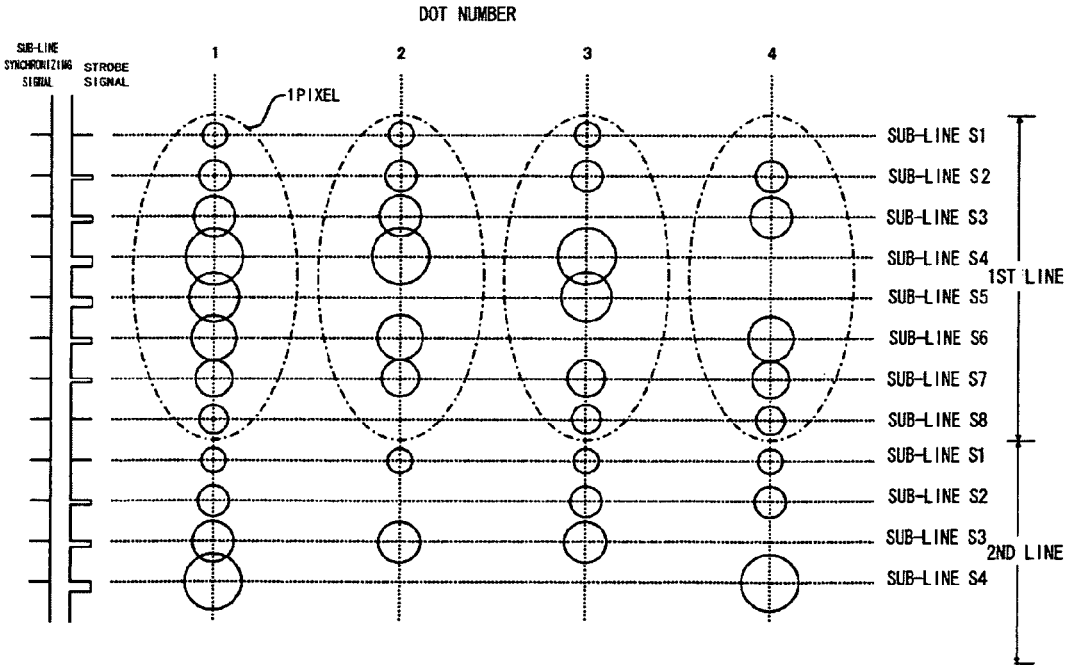
FIG. 5 is a diagram showing a relationship between printing dots and sub-lines in the embodiment of the invention.

Referring to FIG. 5, light emitting patterns of the LED exposure section 115 is described below. The light emitting amount of one pixel is an accumulated light emitting amount of the eight sub-lines constituted of sub-lines 1 to 8 having different prescribed light emitting amounts. In other words, the sub-lines 1-8 divide a pixel into 8 sub-pixels, and the light emitting amount of the pixel is the accumulated result of that of the 8 sub-pixels. A strobe signal indicates light emitting time of each sub-line. The sub-line synchronizing signal is a synchronizing signal made of a pulse signal having a predetermined clock frequency for light emitting timings of the respective sub-lines.

Figures 6, 7:
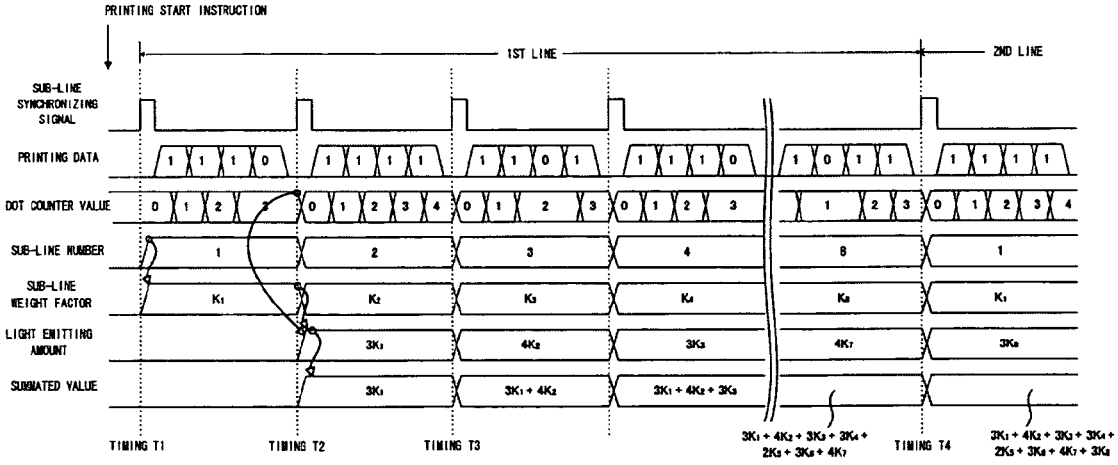
FIG. 6 is a table showing a relationship between sub-line numbers and bit values in the embodiment of the invention.
FIG. 7 is a time chart for describing operation of the embodiment of the invention.

In FIG. 5, exemplified printing data of the respective sub-lines transferred from the image controller 15 to LED exposure section 115 are shown on the respective sub-lines. FIG. 6 shows data indicated in a binary method as bit data. Printing data having four dots is expressed as four bits. That is, bit 0 corresponds to dot 1; bit 1 corresponds to dot 2; bit 2 corresponds to dot 3; bit 3 corresponds to dot 4. Where the data is "1", the device is turned on, and where the data is "0", the device is turned off. At the sub-line S1 of the first line, the dot 1, dot 2, and dot 3 are turned on whereas the dot 4 is not turned on. At the sub-line S2 of the first line, the dot 1, dot 2, dot 3, and dot 4 are turned on whereas no dot is turned off. Similarly, at other sub-lines, the light emitting pattern shown in FIG. 5 is the light emitting pattern corresponding to the printing data shown in FIG. 6.

In FIG. 5, four light emitting patterns of the dot number 1 to 4 are indicated, but the pattern number of the light emitting amount of the pixel controlled with the eight sub-lines having light emitting amounts different from each other reaches 256 patterns (eighth power of two) in total. When the dividing number is changed, the pattern number becomes different. In this image forming apparatus, one sub-line among the eight sub-lines constituting one pixel may be set for a light emitting amount at least necessary for expressing grayscales to realize a linearity of the light emitting amount, and remaining seven sub-lines may be used for controlling the light emitting amount of 128 patterns (seventh power of two).

Where the remaining seven sub-lines control the light emitting amount of 128 patterns, an amount Pmin assigned to one sub-line is set to a light emitting amount at least necessary for expressing grayscales, or namely to a maximum light emitting amount not consuming the toner, and an amount Pmax is set to a light emitting amount maximum necessary for expressing grayscales. A light emitting amount of one sub-line among all of the eight sub-lines is set to the amount Pmin, and because the light emitting amounts from Pmin to Pmax are controlled with the remaining seven sub-lines, the respective light emitting amounts are set properly.

As shown in FIG. 5, to suitably express the grayscale of each pixel, the light emitting time per one sub-line is not even at the respective light emitting diodes, and the pulse width of the strobe signal is changed periodically among the sub-lines. With the image forming apparatus according to this embodiment, the pulse widths of the strobe signals of the sub-lines S4, S5 are set to be the widest, whereas the widths of the strobe signals of the sub-lines S1, S8 are set to be the narrowest. According to changes of the widths of the strobe signals, the light emitting times or namely the light emitting amounts of the corresponding light emitting diodes are changed, and the grayscale expression corresponding to the changes of the light emitting amounts is correspondingly outputted.

Figure 4:
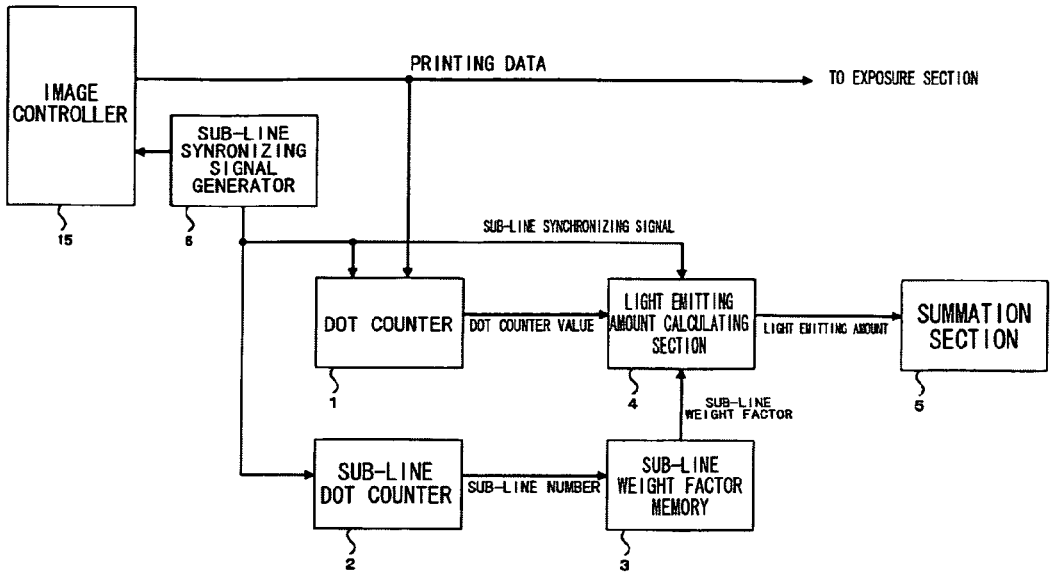
FIG. 4 is a system block diagram showing a calculating system for toner consumption amount in the embodiment of the invention.

FIG. 4 is a system block diagram for this embodiment. The image forming apparatus according to this embodiment includes a toner consumption calculating system for calculating the toner consumption with high accuracy as a part of the control system. The toner consumption calculating system is constituted of a dot counter 1 for counting up a number of turned-on dots, a sub-line counter 2 for outputting the sub-line number according to the synchronizing signal, a sub-line weight factor memory 3 for outputting the weight factors corresponding to the light emitting amount, a light emitting amount calculating section 4 for multiplying the dot counter value by the weight factor, a summation section 5 for summating the output data from the light emitting amount calculating section, a sub-line synchronizing signal generating section 6 for generating a sub-line synchronizing signal, and the image controller 15 for outputting printing data serving as image data.

The sub-line synchronizing signal generating section 6 outputs the sub-line synchronizing signal at a constant interval to begin transferring of the printing data to the exposing device, or namely, the LED exposure section 115. The sub-line synchronizing signal thus outputted from the sub-line synchronizing signal generating section 6 is supplied respectively to the dot counter 1, the sub-line counter 2, the sub-line weight factor memory 3, and the light emitting amount calculating section 4.

The image controller 15 outputs the printing data of one sub-line in response to the sub-line synchronizing signal. The printing data outputted from the image controller 15 are supplied to the exposing device, and are used for light emitting patterns of the light emitting diodes disposed at the exposing device. The printing data outputted from the image controller 15 are further supplied to the dot counter 1 for counting up the dot number.

The dot counter 1 counts up the turned-on dot number in the printing data in response to the sub-line synchronizing signal, and outputs the counted dot counter value to the light emitting amount calculating section 4. The dot counter 1, when detecting the subsequent sub-line synchronizing signal, clarifies the dot counter value and begins counting the value for the next sub-line.

The sub-line counter 2, in response to the sub-line synchronizing signal, outputs the sub-line number indicating which sub-line data correspond to the printing data transferred from the image controller 15. Because the sub-line is outputted sequentially, the sub-line number is a value added one by one at the timing of the sub-line synchronizing signal, and is reset when the operation moves to the subsequent line.

The sub-line weight factor memory 3 memorizes the weight factors of the respective sub-lines in a form of memory tables, and outputs the corresponding sub-line weight factors in response to the sub-line number indicated by the sub-line counter 2. In this embodiment, the weight factors corresponding to the sub-line numbers #1, #8 are relatively small values, whereas the weight factors corresponding to the sub-line numbers #4, #5 are relatively large values.

The light emitting amount calculating section 4, in response to the sub-line synchronizing signal, calculates the light emitting amount based on the dot counter value outputted from the dot counter 1 and the sub-line weight factor outputted from the sub-line weight factor memory 3 and delivers the light emitting amount to the summation section 5. The sub-line weight factor is a constant corresponding to the actual light emitting intensity, and the calculated light emitting amount precisely reflects the light emitting amount of actual light emitting devices because the sub-line weight factor is responding surely to periodical changes of the light emitting intensity among the sub-lines.

The summation section 5 summates the light emitting amount outputted from the light emitting amount calculating section 4. With such a summation, the ultimate toner consumption amount can be detected. The data showing the toner consumption amount as an amount summated at the summation section 5 is transmitted to the image controller 15. If the consumption amount reaches a range that the toner becomes impaired, the image controller 15 can indicate such a message, or can adjust control for voltage or speed relating to printing operation.

Operation of the image forming apparatus according to this embodiment is described, as exemplifying a light emitting pattern of four pixels of one line shown in FIG. 5, with reference to a time chart shown in FIG. 7.

First, the sub-line weight factor memory 3 in advance stores a sub-line weight factor K1 for sub-line S1, a sub-line weight factor K2 for sub-line S2, a sub-line weight factor K3 for sub-line S3, a sub-line weight factor K4 for sub-line S4, a sub-line weight factor K5 for sub-line S5, a sub-line weight factor K6 for sub-line S6, a sub-line weight factor K7 for sub-line S7, and a sub-line weight factor K8 for sub-line S8.

Upon receiving a printing instruction from a host apparatus not shown, the sub-line synchronizing signal generating section 6 output a first sub-line synchronizing signal. Subsequently, at timing T1, printing data transfer of the sub-line S1 of the first line is started from the image controller 15. The sub-line counter 2 outputs a signal of the sub-line number "1" indicating the sub-line S1 upon receiving the pulse of the sub-line synchronizing signal. The sub-line weight factor memory 3 receives the data of the sub-line number "1" from the sub-line counter 2 and outputs the sub-line weight factor K1 of the sub-line S1.

During the period from timing T1 to timing T2, the dot counter 1 counts up "1" showing the turned-on dots in the printing data of the sub-line S1. In the example shown in FIG. 5, the printing data of the sub-line S1 are "1, 1, 1, 0", and the number of "1" is three.

At timing T2, when the second sub-line synchronizing signal is outputted, the light emitting amount calculating section 4 calculates a light emitting amount 3K1 by multiplying the dot counter value "3" by the sub-line weight factor K1, and outputs the light emitting amount 3K1 to the summation section 5. The summation section 5 memorizes the calculated amount 3K1 of the light emitting amount.

The host apparatus, in response to the sub-line synchronizing signal, starts printing data transfer of the sub-line S2 as following to the sub-line S1. The dot counter 1 clarifies the dot counter value to be zero in response to the sub-line synchronizing signal and starts the dot counting of the subsequent sub-line. The sub-line counter 2, in response to the sub-line synchronizing signal, outputs the subsequent sub-line number "2" to the sub-line weight factor memory 3. The sub-line weight factor memory 3 outputs the sub-line weight factor K2 because the received sub-line number is "2".

During the period from timing T2 to T3, the dot counter 1 counts up "1" indicating the turned-on dots in the printing data of the sub-line S2. In the pattern shown in FIG. 5, the printing data of the sub-line S2 is "1, 1, 1, 1", and therefore, the number of "1" is four.

At timing T3, when the third sub-line synchronizing signal is outputted, the light emitting amount calculating section 4 calculates the light emitting amount 4K2 from the dot counter value "4" and the sub-line weight factor K2 and outputs the amount. A summation value 3K1+4K2 in which the previous value 3K1 of the light emitting amount is added to the current value 4K2 is memorized in the summation section 5.

Subsequently, the host apparatus responds to the sub-line synchronizing signal and begins the printing data transfer of the sub-line S3. The dot counter 1, in response to the sub-line synchronizing signal, clarifies the dot counter value to be zero and begins counting up the dot number of the subsequent sub-line. The sub-line counter 2, in response to the sub-line synchronizing signal, indicates the subsequent sub-line number "3". The sub-line weight factor memory 3 outputs the sub-line weight factor K3 to the light emitting amount calculating section 4.

Substantially the same steps are executed thereafter, and when the ninth sub-line synchronizing signal is outputted at timing T4, the light emitting amount calculating section 4 calculates the light emitting amount 3K8 from the dot counter value "8" and the sub-line weight factor K8 and delivers the light emitting amount. In this cycle, the summation section 5 memorizes the light emitting amount's summation value 3K1+4K2+3K3+3K4+2K5+3K6+4K7+3K8. This summation value is used for calculation of the toner consumption amount.

The host apparatus in response to the sub-line synchronizing signal begins printing data transfer of the sub-line S1 of the second line. The dot counter 1 clarifies the dot counter value to be zero in response to the sub-line synchronizing signal and starts the dot counting of the subsequent sub-line. The sub-line counter 2, in response to the sub-line synchronizing signal, outputs the sub-line number "1". The sub-line weight factor memory 3 outputs the sub-line weight factor K1. Hereinafter, substantially the same steps are repeated to seek the summation value of the entire light emitting amounts.

It is to be noted that the values of weight factors K1 to K8 corresponding to the respective sub-lines can be determined on the basis of weighting applications to the respective sub-line light emitting amounts in association with the entire light emitting amounts at a time that the sub-lines for one pixel are fully turned on.

The toner consumption amount can be calculated with following Formula (I) using a toner consumption of one dot sought from actual measurements done in advance.

Formula (1)

$$\text{Toner consumption amount}=(\text{light emitting amount's summation value})/(K1+K2+K3+K4+K5+K6+K7+K8)\times(\text{toner consumption amount of one dot}) \quad (1)$$

The values of the weight factors K1 to K8 corresponding to the respective sub-lines can be sought based on a toner consumption amount obtained from respective sub-lines' light emitting amounts measured from actual measurements. In this situation, a following further simplified Formula (2) can be used for seeking the toner consumption amount precisely.

Formula (2)

$$\text{Toner consumption amount}=\text{Light emitting amount's summation value} \quad (2)$$

Furthermore, in a case that printing is made where one sub-line among the eight sub-lines constituting one pixel is set to the sub-line of light emitting amount Pmin not consuming the toner, the toner consumption amount can be sought in substantially the same manner as the above method using Formulae (1), (2) where the sub-line weight factor of the sub-line to which Pmin sets is assumed as zero.

As described above, according to the image forming apparatus of the embodiment, a proper light emitting amount can be summated corresponding to the light emitting amounts different from each other. With the image forming apparatus, the toner consumption amount can be sought accurately with the simpler structure. The image controller, or the CPU, may preset the turned-on dot numbers to be multiplied as well as the average values or standard values of the weight factors, thereby allowing calculations in which varied data are calculated using deviations from such values, and allowing the weight factors to become negative partly.

Figure 8:
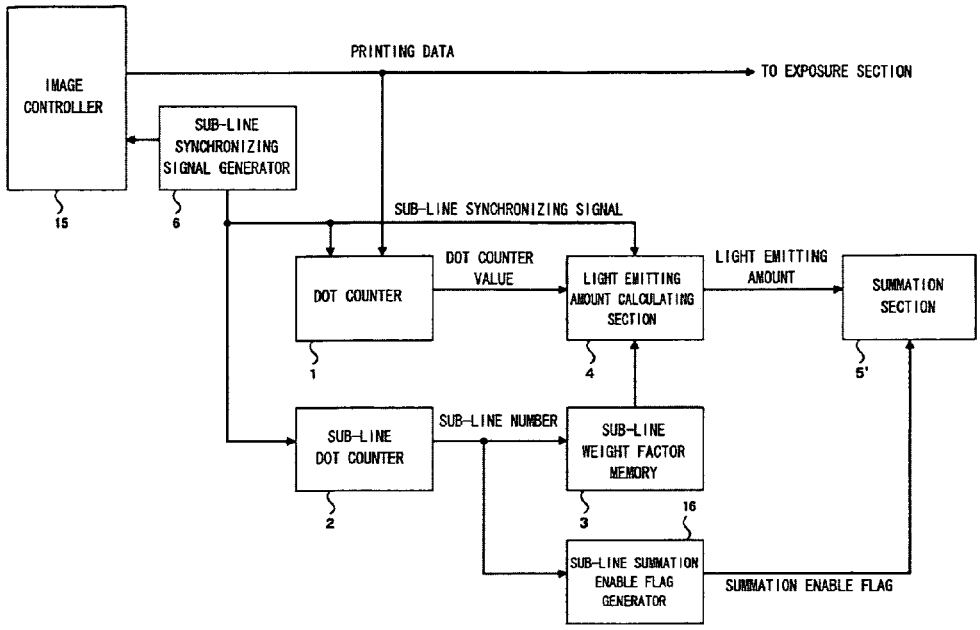
FIG. 8 is a system block diagram showing a calculating system for toner consumption amount in another embodiment of the invention.
Figure 9:
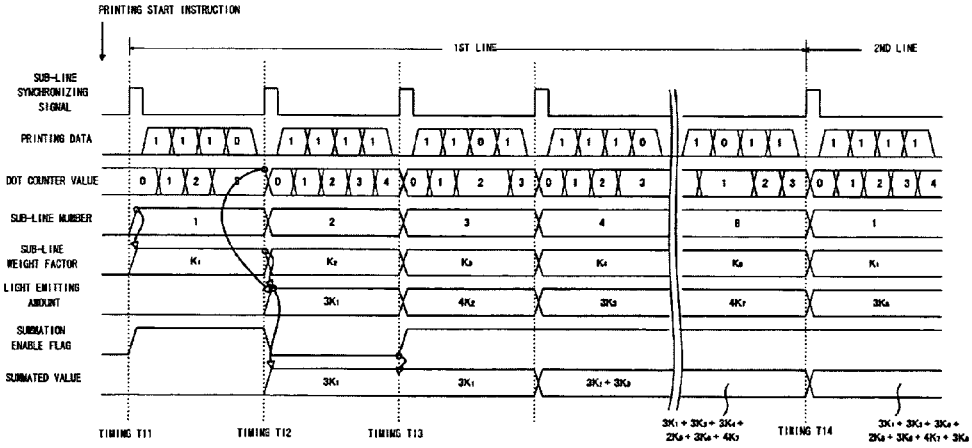
FIG. 9 is a time chart for describing operation of the embodiment of the invention.

Referring to FIGS. 8, 9, the image forming apparatus according to the second embodiment of the invention is described. The image forming apparatus in this embodiment includes, as a part of the control system, a toner consumption amount summation system in which the toner consumption amount is calculated with high accuracy. The toner consumption amount summation system includes a dot counter 1 for counting up a number of turned-on dots, a sub-line counter 2 for outputting the sub-line number according to the synchronizing signal, a sub-line weight factor memory 3 for outputting the weight factors corresponding to the light emitting amount, a light emitting amount calculating section 4 for multiplying the dot counter value by the weight factor, a summation section 5' for summating the output data from the light emitting amount calculating section, a sub-line synchronizing signal generating section 6 for generating a sub-line synchronizing signal, and the image controller 15 for outputting printing data serving as image data, and a sub-line summation enable flag generator 16.

In substantially the same way as in the first embodiment, the sub-line synchronizing signal generating section 6 outputs the sub-line synchronizing signal at a constant interval. The sub-line synchronizing signal thus outputted from the sub-line synchronizing signal generating section 6 is supplied respectively to the dot counter 1, the sub-line counter 2, the sub-line weight factor memory 3, the light emitting amount calculating section 4, and the sub-line summation enable flag generator 16.

The image controller 15 outputs the printing data of one sub-line in response to the sub-line synchronizing signal. The printing data outputted from the image controller 15 are supplied to the exposing device, and are used for light emitting patterns of the light emitting diodes disposed at the exposing device. The printing data outputted from the image controller 15 are further supplied to the dot counter 1 for counting up the dot number.

The dot counter 1 counts up the turned-on dot number in the printing data in response to the sub-line synchronizing signal, and outputs the counted dot counter value to the light emitting amount calculating section 4. The dot counter 1, when detecting the subsequent sub-line synchronizing signal, clarifies the dot counter value and begins counting the value for the next sub-line.

The sub-line counter 2, in response to the sub-line synchronizing signal, outputs, to the sub-line weight factor memory 3 and the sub-line summation enable flag generator 16, the sub-line number indicating which sub-line data correspond to the printing data transferred from the image controller 15. Because the sub-line is outputted sequentially, the sub-line number is a value added one by one at the timing of the sub-line synchronizing signal, and is reset when the operation moves to the subsequent line.

The sub-line weight factor memory 3 memorizes the weight factors of the respective sub-lines in a form of memory tables, and outputs the corresponding sub-line weight factors in response to the sub-line number indicated by the sub-line counter 2. In this embodiment, the weight factors corresponding to the sub-line numbers #1, #8 are relatively small values, whereas the weight factors corresponding to the sub-line numbers #4, #5 are relatively large values.

The sub-line summation enable flag generator 16 memorizes information allowing or not allowing summation of the light emitting amounts of the respective sub-lines, and outputs to the summation section 5' the summation enable flag indicating "1" where the light emitting amount of the present sub-line is summated and "0" where the light emitting amount of the present sub-line is not summated, in response to the sub-line number indicated by the sub-line counter 2.

The light emitting amount calculating section 4, in response to the sub-line synchronizing signal, calculates the light emitting amount based on the dot counter value outputted from the dot counter 1 and the sub-line weight factor outputted from the sub-line weight factor memory 3 and delivers the light emitting amount to the summation section 5'. The sub-line weight factor is a constant corresponding to the actual light emitting intensity, and the calculated light emitting amount precisely reflects the light emitting amount of actual light emitting devices because the sub-line weight factor is responding surely to periodical changes of the light emitting intensity among the sub-lines.

The summation section 5' summates the light emitting amount outputted from the light emitting amount calculating section 4 in accordance with the summation enable flag as a signal supplied from the sub-line summation enable flag generator 16. With such a summation, the ultimate toner consumption amount can be detected. The data showing the toner consumption amount as an amount summated at the summation section 5' is transmitted to the image controller 15. If the consumption amount reaches a range that the toner becomes impaired, the image controller 15 can indicate such a message, or can adjust control for voltage or speed relating to printing operation.

Next, operation of the image forming apparatus according to the second embodiment is described, as exemplifying a light emitting pattern of four pixels of one line shown in FIG. 5, with reference to a time chart shown in FIG. 9, in a case that printing is made upon setting the maximum light emitting amount Pmin not consuming toner.

In substantially the same way as in the first embodiment, the sub-line weight factor memory 3 in advance stores a sub-line weight factor K1 for sub-line S1, a sub-line weight factor K2 for sub-line S2, a sub-line weight factor K3 for sub-line S3, a sub-line weight factor K4 for sub-line S4, a sub-line weight factor K5 for sub-line S5, a sub-line weight factor K6 for sub-line S6, a sub-line weight factor K7 for sub-line S7, and a sub-line weight factor K8 for sub-line S8.

The sub-line summation enable flag generator 16 stores information that the sub-line S2 is not summated. In this operation, the sub-line S2 is set as the maximum light emitting amount Pmin not consuming toner, so that no summation relating to the sub-line S2 is not performed.

Upon receiving a printing instruction from a host apparatus not shown, the sub-line synchronizing signal generating section 6 output a first sub-line synchronizing signal. Subsequently, at timing T11, printing data transfer of the sub-line S1 of the first line is started from the image controller 15. The sub-line counter 2 outputs a signal of the sub-line number "1" indicating the sub-line S1 upon receiving the pulse of the sub-line synchronizing signal. The sub-line weight factor memory 3 receives the data of the sub-line number "1" from the sub-line counter 2 and outputs the sub-line weight factor K1 of the sub-line S1.

During the period from timing T11 to timing T12, the dot counter 1 counts up "1" showing the turned-on dots in the printing data of the sub-line S1. In the example shown in FIG. 5, the printing data of the sub-line S1 are "1, 1, 1, 0", and the number of "1" is three.

At timing T12, when the second sub-line synchronizing signal is outputted, the light emitting amount calculating section 4 calculates a light emitting amount 3K1 by multiplying the dot counter value "3" by the sub-line weight factor K1, and outputs the light emitting amount 3K1 to the summation section 5'. Because the summation enable flag generated at the sub-line summation enable flag generator 16 is "1", and because it is a flag status allowing summation, the summation section 5' memorizes the calculated amount 3K1 of the light emitting amount.

The host apparatus, in response to the sub-line synchronizing signal, starts printing data transfer of the sub-line S2 as following to the sub-line S1. The dot counter 1 clarifies the dot counter value to be zero in response to the sub-line synchronizing signal and starts the dot counting of the subsequent sub-line. The sub-line counter 2, in response to the sub-line synchronizing signal, outputs the subsequent sub-line number "2" to the sub-line weight factor memory 3. The sub-line weight factor memory 3 outputs the sub-line weight factor K2 because the received sub-line number is "2".

During the period from timing T12 to T13, the dot counter 1 counts up "1" indicating the turned-on dots in the printing data of the sub-line S2. In the pattern shown in FIG. 5, the printing data of the sub-line S2 is "1, 1, 1, 1", and therefore, the number of "1" is four.

At timing T13, when the third sub-line synchronizing signal is outputted, the light emitting amount calculating section 4 calculates the light emitting amount 4K2 from the dot counter value "4" and the sub-line weight factor K2 and outputs the amount. However, the summation enable flag generated at the sub-line summation enable flag generator 16 is "0" at the sub-line S2 as the flag status indicating that the summation is not allowed, the previous value 3K1 of the light emitting amount is memorized as the summated value as it is without being added with the current value 4K2.

Subsequently, the host apparatus responds to the sub-line synchronizing signal and begins the printing data transfer of the sub-line S3. The dot counter 1, in response to the sub-line synchronizing signal, clarifies the dot counter value to be zero and begins counting up the dot number of the subsequent sub-line. The sub-line counter 2, in response to the sub-line synchronizing signal, indicates the subsequent sub-line number "3". The sub-line weight factor memory 3 outputs the sub-line weight factor K3 to the light emitting amount calculating section 4.

Substantially the same steps are executed thereafter, and when the ninth sub-line synchronizing signal is outputted at timing T14, the light emitting amount calculating section 4 calculates the light emitting amount 3K8 from the dot counter value "8" and the sub-line weight factor K8 and delivers the light emitting amount. In this cycle, the summation section 5' memorizes the light emitting amount's summation value 3K1+3K3+3K4+2K5+3K6+4K7+3K8. This summation value is used for calculation of the toner consumption amount.

The host apparatus in response to the sub-line synchronizing signal begins printing data transfer of the sub-line S1 of the second line. The dot counter 1 clarifies the dot counter value to be zero in response to the sub-line synchronizing signal and starts the dot counting of the subsequent sub-line. The sub-line counter 2, in response to the sub-line synchronizing signal, outputs the sub-line number "1". The sub-line weight factor memory 3 outputs the sub-line weight factor K1. Hereinafter, substantially the same steps are repeated to seek the summation value of the entire light emitting amounts.

It is to be noted that the values of weight factors K1 to K8 corresponding to the respective sub-lines can be determined on the basis of weighting applications to the respective sub-line light emitting amounts in association with the entire light emitting amounts at a time that the sub-lines for one pixel are fully turned on.

The toner consumption amount can be calculated with the following formula (3) using a toner consumption of one dot sought from actual measurements done in advance.

Formula (3)

$$\text{Toner consumption amount}=(\text{light emitting amount's summation value})/(K1+K3+K4+K5+K6+K7+K8)\times(\text{toner consumption amount of one dot}) \quad (3)$$

The values of the weight factors K1 to K8 corresponding to the respective sub-lines can be sought based on a toner consumption amount obtained from respective sub-lines' light emitting amounts measured from actual measurements. In this situation, a following further simplified Formula (4) can be used for seeking the toner consumption amount precisely.

Formula (4)

$$\text{Toner consumption amount}=\text{Light emitting amount's summation value} \quad (4)$$

As described above, according to the image forming apparatus of the embodiment, a proper light emitting amount can be summated corresponding to the light emitting amounts different from each other. With the image forming apparatus, the toner consumption amount can be sought accurately with the simpler structure. The image controller, or the CPU, may preset the turned-on dot numbers to be multiplied as well as the average values or standard values of the weight factors, thereby allowing calculations in which varied data are calculated using deviations from such values, and allowing the weight factors to become negative partly.

Furthermore, where printing is made without setting the sub-line S2 having the maximum light emitting amount Pmin not consuming toner, it is preferable to memorize information summating for all of the sub-lines in the sub-line summation enable flag generator 16. In such operation, the toner consumption amount can be sought using Formulae (1), (2) as described in the first embodiment. Although in this embodiment the sub-line S2 is set as the sub-line subjecting to the maximum light emitting amount Pmin not consuming toner, other sub-lines can be subject to the maximum light emitting amount Pmin not consuming toner, and not only a single sub-line but also plural sub-lines can be subject to the maximum light emitting amount Pmin not consuming toner.

Figure 10:
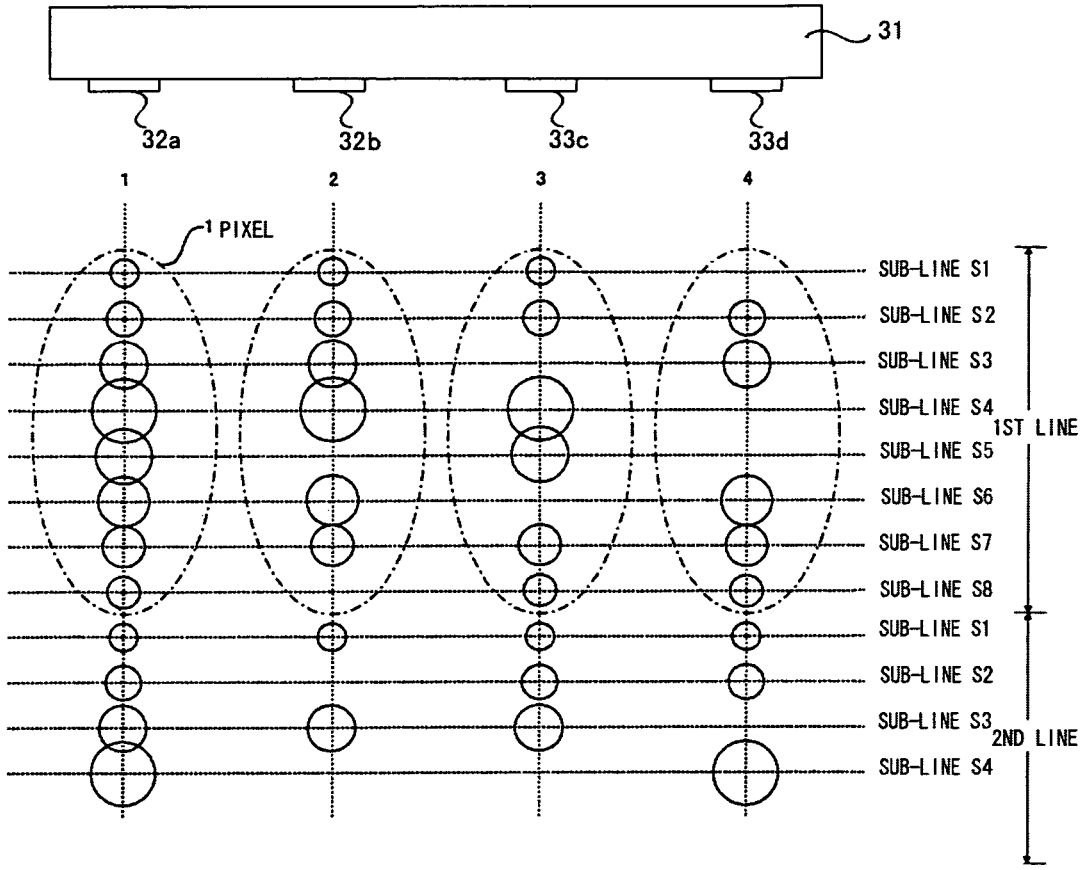
FIG. 10 is a diagram showing a relationship between printing dots and sub-lines in yet another embodiment of the invention.

Referring to FIG. 10, a modification of an image forming apparatus according to the invention is described. An LED head 31 is formed as to face to a medium, and the medium is moved through a space below the LED head 31 in the conveyance direction in FIG. 10 to print two-dimensional images. The LED head 31 is constituted of light emitting devices 32*a*, 32*b*, 32*c*, 32*d*, as shown in a partly omitting manner, arranged in a line along a direction perpendicularly to the medium conveyance direction. The light emitting amounts of the light emitting devices 32*a*, 32*b*, 32*c*, 32*d* periodically vary in the medium conveyance direction because the medium moves in the conveyance direction in FIG. 10. Even where such an LED head 31 is used, a precise toner consumption amount can be sought using the system shown in FIG. 4 or FIG. 8.

The image forming apparatus according to each embodiment of the invention can be used for binary or monochrome printing in which no grayscale expression is used at one pixel. The toner consumption amount can be sought from Formula (1) under operation where the sub-line synchronizing signal outputted from the sub-line synchronizing signal generator 6 is treated as a line synchronizing signal and where sub-line weight factors are set for each sub-lines. The toner consumption amount also can be sought from Formula (2) under operation where the sub-line weight factor is set to a value based on the toner consumption amount of one dot. Toner is not limited to one for monochrome, and toners of multiple colors can be used.

It is to be noted that in the above embodiments, the image forming apparatus is described as the electrophotographic printer, but the image forming apparatus according to the invention can be any of printers, facsimile machines, photocopiers, scanners, and complex machines combining one or more of those apparatuses.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming apparatus capable of detecting a toner consumption amount of an image, comprising:

a dot counter for counting a number of turned-on dots for each of the plurality of sub-lines of the image, the plurality of sub-lines each corresponding to a light-emitting amount and dividing a pixel of the image into a plurality of sub-pixels;

a sub-line counter for outputting a sub-line number for each of the plurality of sub-lines whose light emitting amount is periodically changed at respective dots;

a sub-line weight factor memory for keeping a weight factor for each of the plurality of sub-lines;

a light emitting amount calculating section for calculating a light emitting amount for a selected sub-line, the light emitting amount being based on the number of turned-on dots for the selected sub-line outputted from said dot counter, and the sub-line weight factor outputted for the selected sub-line from said sub-line weight factor memory, using a selected sub-line number of the selected sub-line from the sub-line counter; and a summation section for summating light emitting amounts calculated at said light emitting amount calculating section for all sub-lines to obtain a summated amount, the toner consumption amount being calculated based on said summated amount.

2. The image forming apparatus according to claim 1, wherein said dot counter counts the turned-on dot number for each main scanning line with respect to the image data.

3. The image forming apparatus according to claim 1, wherein the light emitting amount is a value relating to a light emitting time of each dot.

4. The image forming apparatus according to claim 1, further comprising a sub-line synchronizing signal generating section for outputting a sub-line synchronizing signal.

5. The image forming apparatus according to claim 4, wherein said sub-line counter changes the sub-line number upon reception of the sub-line synchronizing signal.

6. The image forming apparatus according to claim 1, wherein summation or non-summation of the light emitting amount summated can be switched for each sub-line.

* * * * *